US011794201B2

(12) United States Patent
Yashima et al.

(10) Patent No.: US 11,794,201 B2
(45) Date of Patent: Oct. 24, 2023

(54) ROTARY ATOMIZING COATING DEVICE

(71) Applicant: HONDA MOTOR CO., LTD., Tokyo (JP)

(72) Inventors: Osamu Yashima, Tokyo (JP); Naoki Kishimoto, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 20 days.

(21) Appl. No.: 17/560,340

(22) Filed: Dec. 23, 2021

(65) Prior Publication Data

US 2022/0226842 A1 Jul. 21, 2022

(30) Foreign Application Priority Data

Jan. 15, 2021 (JP) ..... 2021-005298

(51) Int. Cl.
*B05B 5/04* (2006.01)
*B05B 3/10* (2006.01)

(52) U.S. Cl.
CPC ..... *B05B 5/0407* (2013.01); *B05B 3/1014* (2013.01); *B05B 3/1057* (2013.01); *B05B 5/0418* (2013.01)

(58) Field of Classification Search
CPC ... B05B 5/0407; B05B 5/0418; B05B 3/1014; B05B 3/1057
USPC ..... 239/703
See application file for complete search history.

(56) References Cited

U.S. PATENT DOCUMENTS 5,183,210 A * 2/1993 Takeishi ..... B05B 5/0407 239/300
5,894,993 A * 4/1999 Takayama ..... B05B 3/1064 239/223
5,897,060 A * 4/1999 Kon ..... B05B 5/0407 285/321
6,050,499 A * 4/2000 Takayama ..... B05B 15/55 239/296
7,861,945 B2 * 1/2011 Yasuda ..... B05B 3/1014 239/293
8,720,797 B2 * 5/2014 Yamasaki ..... B05B 3/1014 239/222
8,840,043 B2 * 9/2014 Nakazono ..... B05B 5/0407 239/243

(Continued)

FOREIGN PATENT DOCUMENTS

JP 6080127 2/2017
JP 2020-199447 12/2020

OTHER PUBLICATIONS

Japanese Office Action for Japanese Patent Application No. 2021-005298 dated Jul. 5, 2022.

*Primary Examiner* — Tuongminh N Pham
*Assistant Examiner* — Kevin Edward Schwartz
(74) *Attorney, Agent, or Firm* — AMIN, TUROCY & WATSON, LLP

(57) ABSTRACT

A rotary atomizing coating device includes a rotary atomizing head. The rotary atomizing head includes a first bell cup, a second bell cup, and an inner member. The outer peripheral surface of the inner member is provided with paint discharge holes. The paint discharge holes communicate with a paint supply passage. The first bell cup includes a plurality of through holes. The plurality of through holes are disposed near the paint discharge holes. The plurality of through holes communicate with the second bell cup.

5 Claims, 10 Drawing Sheets

(56) References Cited

U.S. PATENT DOCUMENTS

| | | | | |
|---|---|---|---|---|
| 8,905,325 | B2 * | 12/2014 | Ballu | B05B 3/1064 239/700 |
| 10,155,233 | B2 * | 12/2018 | Seitz | B05B 3/1064 |
| 10,343,179 | B2 * | 7/2019 | Ito | B05B 5/0426 |
| 2012/0193453 | A1 * | 8/2012 | Nakazono | B05B 5/0426 239/461 |
| 2018/0185859 | A1 * | 7/2018 | Kishimoto | B05D 1/02 |

* cited by examiner

ROTARY ATOMIZING COATING DEVICE

CROSS-REFERENCE TO RELATED APPLICATIONS

This application is based upon and claims the benefit of priority from Japanese Patent Application No. 2021-005298 filed on Jan. 15, 2021, the contents of which are incorporated herein by reference.

BACKGROUND OF THE INVENTION

Field of the Invention

The present invention relates to a rotary atomizing coating device for performing electrostatic coating by spraying a liquid paint from the distal end of a rotary atomizing head.

Description of the Related Art

Conventionally, there has been known a rotary atomizing coating device for coating an automobile body or the like. The rotary atomizing coating device rotates a rotary atomizing head while applying a high voltage to the rotary atomizing head. In the rotary atomizing coating device, a conductive paint (liquid paint) is supplied to the rotating rotary atomizing head. After the liquid paint is charged and atomized, the atomized liquid paint is sprayed from the distal end edge of the rotary atomizing head. As a result, electrostatic coating for coating a workpiece such as the body with the liquid paint is performed.

For example, a rotary atomizing coating device disclosed in JP 6080127 B2 includes a rotary atomizing head having two head bodies. Each of the head bodies has a bell shape. The two head bodies are coaxially arranged at a predetermined distance from each other in the axial direction. The center of rotation of each of the head bodies is provided with a paint passage forming hole for supplying paint. Each of the head bodies has a plurality of paint passage branch holes. Each of the paint passage branch holes guides the paint from the paint passage forming hole to the surfaces of the two head bodies.

In the rotary atomizing coating device, a centrifugal force is generated by rotation of the rotary atomizing head. The paint is supplied from the paint passage forming hole to each of the plurality of paint passage branch holes, and the paint is scattered to the outside in a mist form from the whole periphery of the outer edge portion of each of the head bodies by the centrifugal force. In this way, the paint is discharged from each of the two head bodies. As a result, the thickness of the liquid film of the paint applied to the workpiece can be reduced, and the particles of the paint can be atomized.

SUMMARY OF THE INVENTION

In the rotary atomizing coating device described above, the paint is supplied through the paint passage branch holes provided in each of the head bodies. This achieves atomization of the paint discharged from the two head bodies. However, when the rotary atomizing head is rotated to discharge the paint, the centrifugal force acting on one of the head bodies that is disposed on the outer side is larger than the centrifugal force acting on the other head body disposed on the inner side. Therefore, a difference is generated between the amount of the paint discharged from one of the head bodies and the amount of the paint discharged from the other head body. As a result, it is difficult to discharge the paint evenly from the two head bodies.

In order to solve this problem, in the rotary atomizing coating device, for example, it is conceivable to appropriately design the number, shape (hole diameter), and the like of the paint passage branch holes in the two head bodies. As a result, the discharge amount (discharge ratio) of the paint from one of the head bodies and the discharge amount (discharge ratio) of the paint from the other head body can be arbitrarily distributed. However, the structure of the rotary atomizing coating device becomes complicated, and the design of the rotary atomizing coating device also becomes complicated.

An object of the present invention is to solve the above-described problems.

According to an aspect of the present invention, provided is a rotary atomizing coating device comprising a rotary atomizing head coupled to a rotary shaft of a rotary drive source and configured to discharge a paint by a centrifugal force caused by rotation thereof, the rotary atomizing coating device coating a workpiece with the discharged paint, wherein the rotary atomizing head includes: a first bell cup including a first paint discharge surface configured to thin the paint by the centrifugal force; a second bell cup fitted to an outer side of the first bell cup and including a second paint discharge surface configured to thin the paint; a paint supply passage which extends in an axial direction of the rotary shaft and through which the paint is supplied; and an inner member disposed inside the first bell cup and communicating with the paint supply passage, and wherein an outer peripheral surface of the inner member includes a paint discharge hole communicating with the paint supply passage, and the first bell cup includes, at a position near the paint discharge hole, a through hole communicating with the second bell cup.

According to the present invention, in the rotary atomizing coating device, the paint discharge hole is provided on the outer peripheral surface of the inner member of the rotary atomizing head. The paint discharge hole communicates with the paint supply passage. The inner member is disposed within the first bell cup. The first bell cup includes the through hole at a position near the paint discharge hole. The through hole communicates with the second bell cup. Thus, the paint can be distributed by adjusting the ratio between the amount of the paint supplied to the first bell cup through the paint discharge hole of the inner member and the amount of the paint supplied to the second bell cup through the first bell cup.

Therefore, compared with the conventional rotary atomizing coating device, the paint can be distributed by adjusting the supply ratio of the paint to the two first and second bell cups with a simple configuration. As a result, even if the supply amount of the paint discharged from each of the first and second bell cups is increased, the thickness of the liquid film of the paint can be reduced. By reducing the thickness of the liquid film of the paint, the particles of the paint can be atomized.

The above and other objects, features, and advantages of the present invention will become more apparent from the following description when taken in conjunction with the accompanying drawings, in which a preferred embodiment of the present invention is shown by way of illustrative example.

DESCRIPTION OF THE INVENTION

Figure 1:
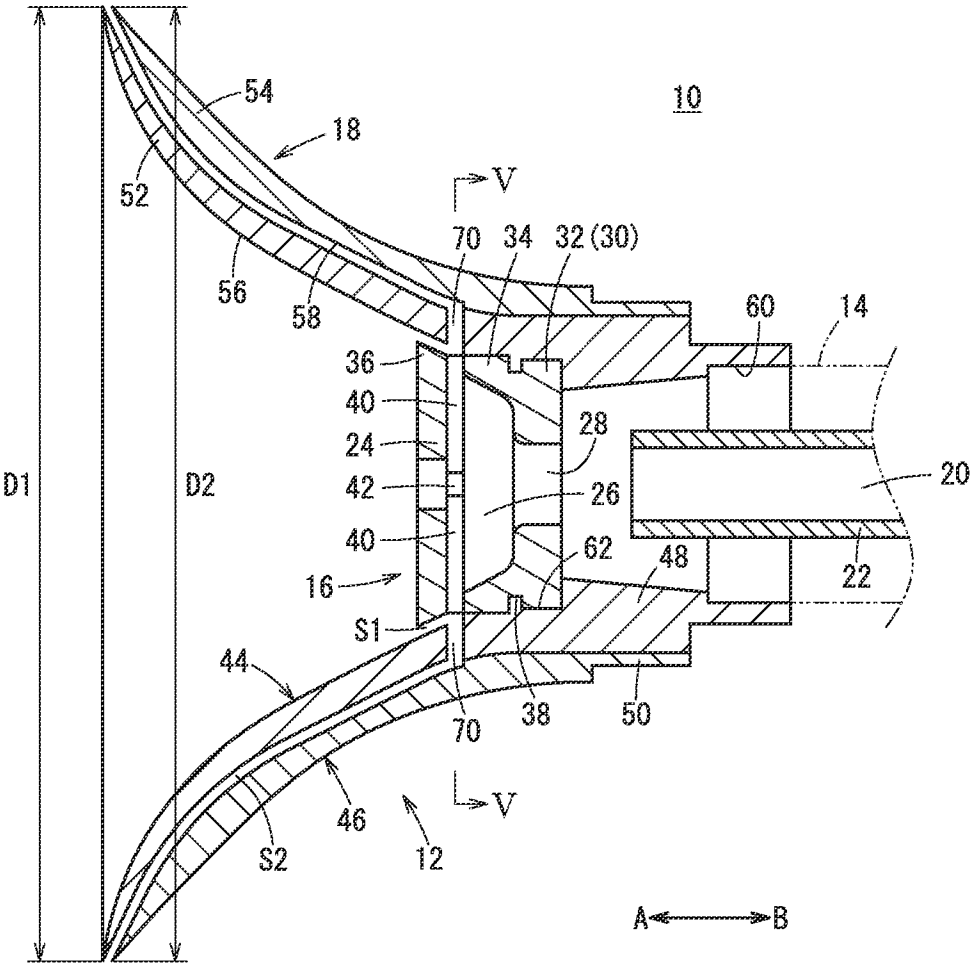
FIG. 1 is an overall cross-sectional view of a rotary atomizing coating device according to a first embodiment of the present invention.
Figure 2:
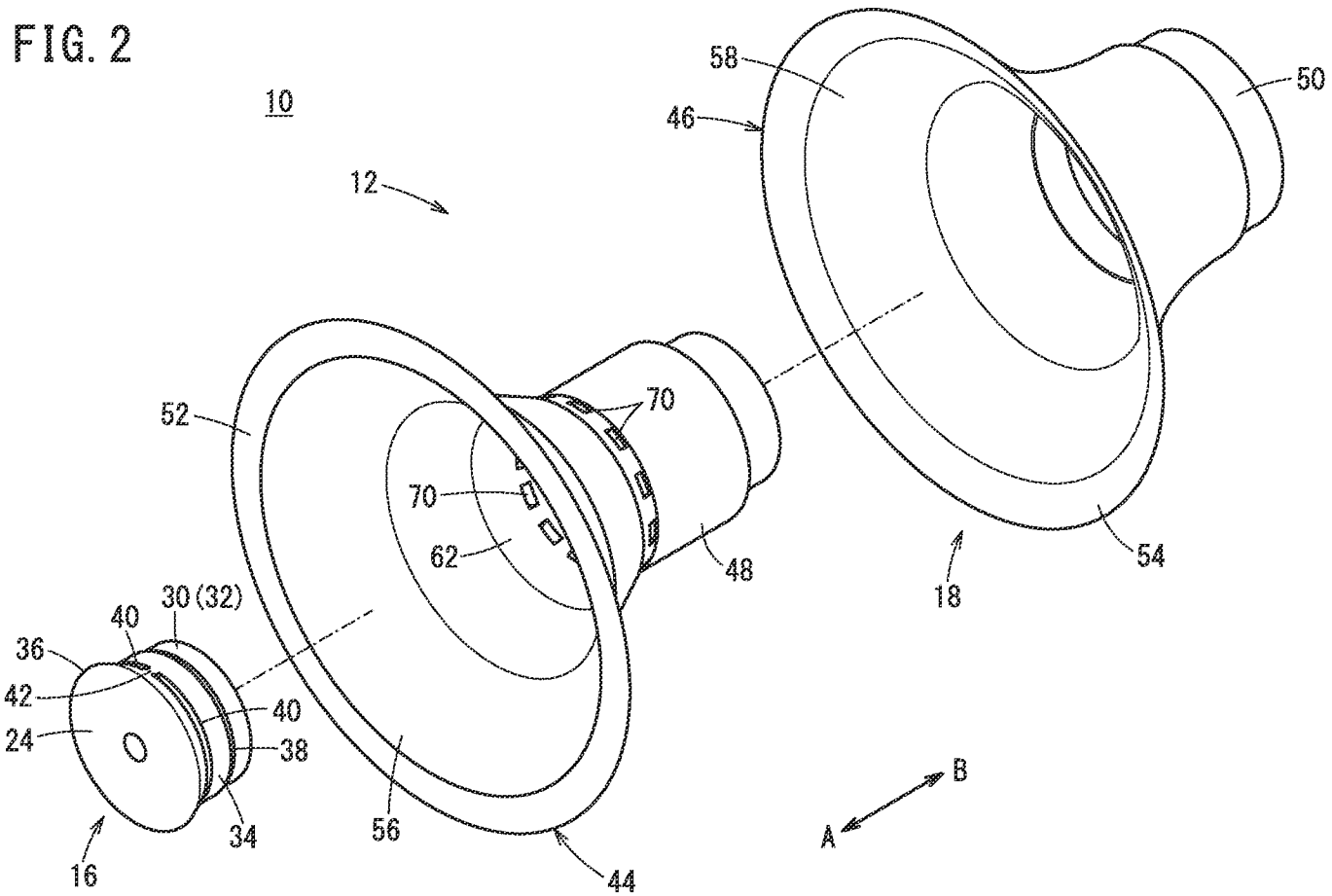
FIG. 2 is an exploded perspective view of a rotary atomizing head in the rotary atomizing coating device of FIG. 1.
Figure 3:
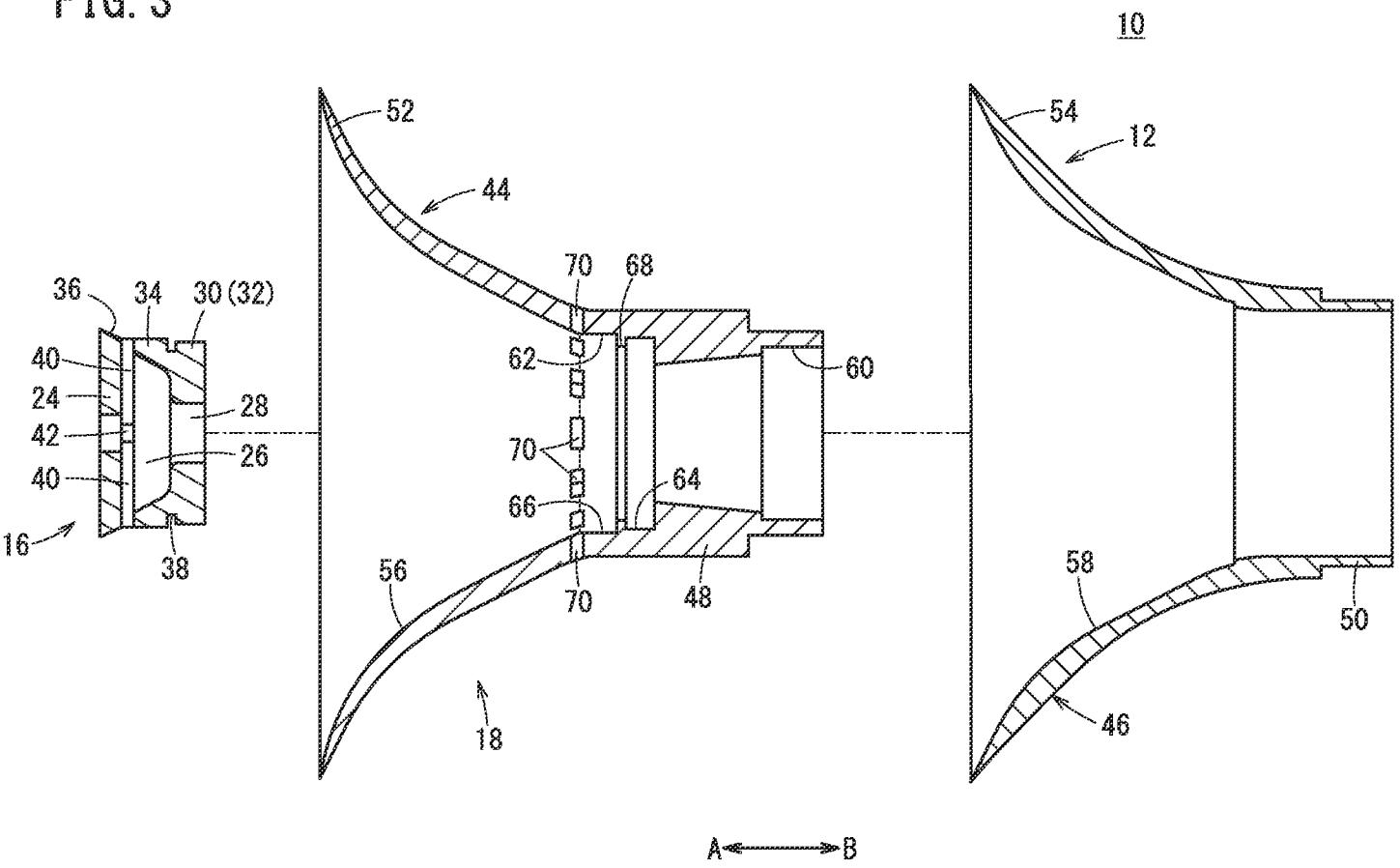
FIG. 3 is an exploded cross-sectional view of the rotary atomizing head in the rotary atomizing coating device of FIG. 1.

As shown in FIGS. 1 to 5, a rotary atomizing coating device 10 includes a rotary atomizing head 12. The rotary atomizing head 12 discharges a paint by utilizing a centrifugal force generated by the rotation of the rotary atomizing head 12. The rotary atomizing head 12 coats a workpiece (not shown), which is an object to be coated, with the paint discharged from the rotary atomizing head 12.

The rotary atomizing head 12 is coupled to the distal end of a rotary shaft 14 of a rotary drive source such as a motor (not shown). The rotary atomizing head 12 includes an inner member 16 and an outer member 18. The outer member 18 is fixed to the outer peripheral portion of the inner member 16. The rotary atomizing head 12 is driven by the rotary drive source (not shown) to rotate. The rotary atomizing head 12 rotates at high speed around the rotary shaft 14 of the rotary drive source. A tube member 22 is disposed inside the rotary shaft 14. The tube member 22 is connected to a paint supply device (not shown). The tube member 22 includes a paint supply passage 20 through which the paint is supplied. The tube member 22 does not rotate together with the rotary shaft 14.

In the following description, in the rotary atomizing coating device 10, a direction toward which the paint is discharged is defined as forward (a front end, an arrow A direction). A direction in which the tube member 22 supplied with the paint is connected is defined as rearward (a rear end, an arrow B direction).

The inner member 16 has a cup shape having a predetermined length in the front-rear direction (directions of arrows A and B). The cross-sectional shape of the inner member 16 is circular. The front end of the inner member 16 is closed by an end wall 24. The rear end of the inner member 16 is open. The inner member 16 has a bottomed tubular shape extending from the front end toward the rear end. A paint storage chamber 26 is provided inside the inner member 16. The paint storage chamber 26 temporarily stores the paint supplied via the tube member 22.

Figure 5:
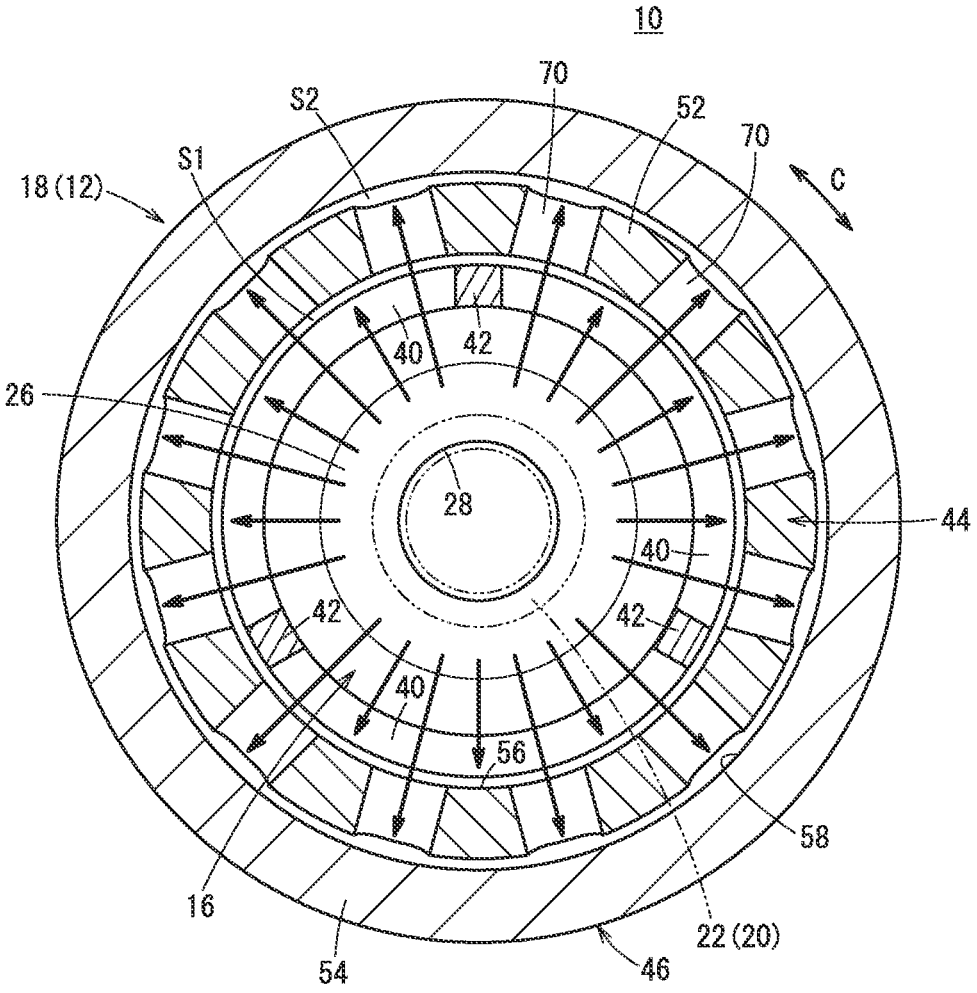
FIG. 5 is a cross-sectional view taken along line V-V of FIG. 1.

The cross-sectional shape of the paint storage chamber 26 is circular when viewed from the front-rear direction of the inner member 16 (see FIG. 5). An opening 28 is formed at the rear end of the paint storage chamber 26. The opening 28 is disposed on a single straight line with the distal end (front end) of the tube member 22. The opening 28 communicates with the tube member 22. The paint storage chamber 26 gradually increases in diameter from the rear end toward the front end (in the arrow A direction).

An outer peripheral wall 30 of the inner member 16 includes a small diameter portion 32, a large diameter portion 34, and an enlarged diameter portion 36. The small diameter portion 32 is positioned closest to the rear end (end portion in the arrow B direction) of the inner member 16. The large diameter portion 34 is positioned forward (on the arrow A side) of the small diameter portion 32. The enlarged diameter portion 36 is positioned further forward (on the arrow A side) of the large diameter portion 34. The enlarged diameter portion 36 is an outer peripheral portion of the end wall 24. The outer peripheral surface of the enlarged diameter portion 36 gradually increases in diameter toward the front (in the arrow A direction). That is, the outer peripheral surface of the enlarged diameter portion 36 is inclined with respect to the axis of the inner member 16.

The outer peripheral wall 30 includes an annular groove 38. The annular groove 38 is disposed between the large diameter portion 34 and the small diameter portion 32. The annular groove 38 is recessed radially inward relative to the small diameter portion 32. The annular groove 38 has an annular shape along the circumferential direction of the outer peripheral wall 30.

The large diameter portion 34 includes a plurality of paint discharge holes 40. The paint discharge holes 40 are disposed adjacent to the rear end of the enlarged diameter portion 36. The width of the paint discharge hole 40 along the front-rear direction of the inner member 16 (the directions of arrows A and B) is constant along the circumferential direction of the inner member 16. The paint discharge hole 40 has, for example, a slit shape. The plurality of paint discharge holes 40 are aligned with each other when viewed from a position in the axial direction in the inner member 16. The paint discharge hole 40 is elongated along the circumferential direction (an arrow C direction in FIG. 5). The paint discharge holes 40 penetrate the large diameter portion 34 in the radial direction. The paint discharge holes 40 allow communication between the outside of the outer peripheral wall 30 and the paint storage chamber 26.

Specifically, as shown in FIG. 5, three paint discharge holes 40 are provided. The paint discharge holes 40 penetrate through the paint storage chamber 26 at a position where the diameter of the paint storage chamber 26 is largest. One paint discharge hole 40 and another paint discharge hole 40 are adjacent to each other in the circumferential direction of the inner member 16. A rib 42 is provided between one paint discharge hole 40 and the other paint discharge hole 40 adjacent to each other. Each of the ribs 42 connects the outer peripheral wall 30 and the end wall 24. The three paint discharge holes 40 are separated from each other in the circumferential direction (the arrow C direction) by the ribs 42. Note that the number of the paint discharge holes 40 is not limited to three as described above, as long as the paint discharge holes 40 are arranged at equal intervals in the circumferential direction.

The paint is supplied to the opening 28 through the tube member 22 (paint supply passage 20). The opening 28 is located at the rear end of the inner member 16. The paint is supplied to the paint storage chamber 26 through the opening 28 of the inner member 16. As the rotary atomizing head 12 including the inner member 16 rotates, a centrifugal force acts on the rotary atomizing head 12. The paint moves radially outward due to the centrifugal force. The paint gradually flows radially outward along the inner peripheral surface of the paint storage chamber 26. Thereafter, the paint flows from the paint storage chamber 26 to the outside of the outer peripheral wall 30 through the plurality of paint discharge holes 40.

As shown in FIGS. 1 to 5, the outer member 18 includes, for example, a first bell cup 44 and a second bell cup 46. Each of the first and second bell cups 44 and 46 has a circular cup shape.

The first bell cup 44 includes a first coupling portion 48 and a first flare portion 52. The first coupling portion 48 is disposed at the rear end (on the arrow B side) of the first bell cup 44. The first coupling portion 48 is coupled to the distal end of the rotary shaft 14. The first flare portion 52 is continuous with the front end of the first coupling portion 48. The first flare portion 52 gradually expands radially outward toward the front side (in the arrow A direction) relative to the first coupling portion 48.

The second bell cup 46 includes a second coupling portion 50 and a second flare portion 54. The second coupling portion 50 is disposed at the rear end (on the arrow B side) of the second bell cup 46. The second coupling portion 50 is coupled to the distal end of the rotary shaft 14 via the first coupling portion 48. The second flare portion 54 is continuous with the front end of the second coupling portion 50. The second flare portion 54 gradually expands radially outward toward the front side (in the arrow A direction) relative to the second coupling portion 50.

The front surface of the first bell cup 44 includes a first paint discharge surface 56. The first paint discharge surface 56 thins the paint supplied to the front surface of the first bell cup 44. The front surface of the second bell cup 46 includes a second paint discharge surface 58. The second paint discharge surface 58 thins the paint supplied to the front surface of the second bell cup 46.

Each of the first and second coupling portions 48 and 50 has a cylindrical shape extending in the front-rear direction (the directions of arrows A and B). A connection hole 60 is provided inside the first coupling portion 48. The rotary shaft 14 of the rotary drive source (not shown) is connected to the connection hole 60. The first bell cup 44 includes a mounting hole 62. The mounting hole 62 is located between the first coupling portion 48 and the first flare portion 52. The inner member 16 is mounted in the mounting hole 62.

The mounting hole 62 has a larger diameter than the connection hole 60. The inner peripheral surface of the mounting hole 62 includes a first step portion 64, a second step portion 66, and an annular protrusion 68.

The first step portion 64 is located most rearward (on the arrow B side) in the mounting hole 62. The small diameter portion 32 of the inner member 16 is engaged with the first step portion 64. The second step portion 66 is disposed forward (on the arrow A side) of the first step portion 64. The large diameter portion 34 is engaged with the second step portion 66. The second step portion 66 has a larger diameter than the first step portion 64. The annular protrusion 68 is disposed between the first step portion 64 and the second step portion 66. The annular protrusion 68 protrudes radially inward from the first step portion 64 and the second step portion 66.

The inner member 16 is inserted into the mounting hole 62 of the first bell cup 44 from the front side. The small diameter portion 32 of the inner member 16 is engaged with the first step portion 64. The large diameter portion 34 of the inner member 16 is engaged with the second step portion 66. The annular protrusion 68 of the inner member 16 is engaged with the annular groove 38. As a result, the inner member 16 and the first bell cup 44 are positioned relative to each other in the front-rear direction (the directions of arrows A and B).

The inner member 16 and the first bell cup 44 are arranged coaxially. The annular protrusion 68 of the first bell cup 44 is engaged with the annular groove 38 of the inner member 16. Accordingly, the first bell cup 44 and the inner member 16 do not move relative to each other in the front-rear direction (the directions of arrows A and B). As a result, the inner member 16 is fixed inside the first bell cup 44. At this time, the enlarged diameter portion 36 of the inner member 16 is disposed inside the first flare portion 52.

The first paint discharge surface 56 of the first flare portion 52 is inclined forward toward the radially outer side. When the first bell cup 44 is viewed from the front-rear direction, the first paint discharge surface 56 is an annular surface. Due to the centrifugal force generated by the rotation of the first bell cup 44, the paint moves radially outward from the paint storage chamber 26 of the inner member 16 along the first paint discharge surface 56. At this time, the paint is thinned.

The mounting hole 62 is disposed at the rear end of the first flare portion 52. The mounting hole 62 is disposed radially inward of the first flare portion 52. The enlarged diameter portion 36 of the inner member 16 is housed in the rear end of the first flare portion 52. The enlarged diameter portion 36 is disposed at a position adjacent to the front end of the mounting hole 62. A first clearance S1 is provided between the first paint discharge surface 56 of the first flare portion 52 and the outer peripheral surface of the enlarged diameter portion 36. The first clearance S1 has an annular shape.

The first paint discharge surface 56 of the first flare portion 52 includes a plurality of through holes 70. The plurality of through holes 70 are disposed radially outward of the enlarged diameter portion 36 of the inner member 16. The plurality of through holes 70 are arranged along the circumferential direction of the first flare portion 52. Each of the through holes 70 has, for example, a rectangular cross-sectional shape elongated in the circumferential direction. The plurality of through holes 70 are aligned with each other when viewed from a position in the front-rear direction of the first flare portion 52 (the directions of arrows A and B). The plurality of through holes 70 are arranged at equal intervals along the circumferential direction of the first flare portion 52. Each through hole 70 penetrates the first flare portion 52 in the radial direction.

The total opening area obtained by adding the opening areas of the plurality of through holes 70 is ½ of the projected area of the first paint discharge surface 56 on which the through holes 70 are projected. That is, the size (cross-sectional shape) of each through hole 70 and the number of the through holes 70 are set such that the total opening area thereof is ½ of the circumferential area of the second paint discharge surface 58 along the circumferential direction on the outer circumferential side of the through holes 70.

The paint is supplied from the paint discharge hole 40 of the inner member 16 toward the first flare portion 52. Half (½) of the supply amount of the paint is supplied to the first paint discharge surface 56 of the first flare portion 52. The remaining half (½) of the paint flows radially outward of the first bell cup 44 through the through holes 70. The remaining half of the paint is supplied to the second bell cup 46.

On the other hand, the second paint discharge surface 58 of the second flare portion 54 is inclined forward toward the radially outer side. When viewed from the front-rear direction of the second bell cup 46, the second paint discharge surface 58 is an annular surface. Due to the centrifugal force generated by the rotation of the second bell cup 46, the paint moves radially outward from the paint storage chamber 26 of the inner member 16 along the second paint discharge surface 58. At this time, the paint is thinned.

In the outer member 18, the first bell cup 44 is housed inside the second bell cup 46. The first coupling portion 48 is fitted into the second coupling portion 50 in the outer member 18. Thus, the first bell cup 44 and the second bell cup 46 are coaxially coupled to each other. A second clearance S2 is provided between the rear surface of the first flare portion 52 and the front surface (second paint discharge surface 58) of the second flare portion 54. The second clearance S2 has an annular shape and extends along the first and second flare portions 52 and 54. The second clearance S2 has a substantially constant width in the radial direction.

As shown in FIG. 1, the front end (large-diameter-side opening) of the first flare portion 52 has a maximum diameter in the first bell cup 44. The front end (large-diameter-side opening) of the second flare portion 54 has a maximum diameter in the second bell cup 46. A maximum outer diameter D1 of the first flare portion 52 is identical to a maximum outer diameter D2 of the second flare portion 54 (D1=D2).

Next, the operation and effects of the rotary atomizing coating device 10 will be described.

When coating a workpiece (not shown), first, the rotary drive source (not shown) is driven. The rotary shaft 14 of the rotary drive source rotates, and the rotary atomizing head 12 rotates at high speed with the rotation of the rotary shaft 14. Paint is supplied from the paint supply source (not shown) to the paint supply passage 20 of the tube member 22.

The paint is supplied to the paint storage chamber 26 of the rotary atomizing head 12 through the paint supply passage 20. In the paint storage chamber 26 shown in FIG. 4, the paint moves radially outward due to the centrifugal force generated by the rotation of the inner member 16. The paint moves toward the front end along the inner peripheral surface of the paint storage chamber 26.

The paint is discharged radially outward from the paint storage chamber 26 through the plurality of paint discharge holes 40. At this time, as shown in FIG. 5, the plurality of paint discharge holes 40 are opened substantially uniformly along the circumferential direction of the inner member 16 (the arrow C direction). Therefore, the paint is discharged substantially uniformly in the circumferential direction of the inner member 16 through the plurality of paint discharge holes 40.

Figure 4:
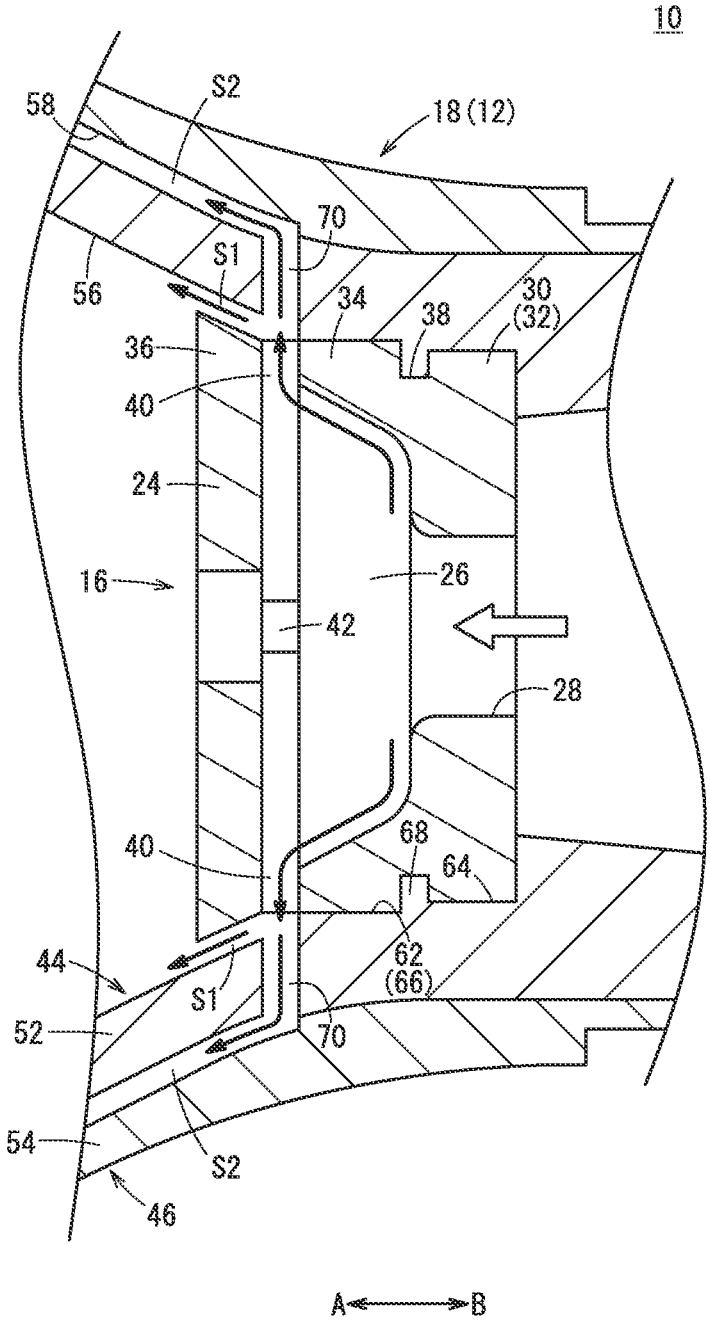
FIG. 4 is an enlarged cross-sectional view of the vicinity of an inner member in the rotary atomizing head of FIG. 1.

As shown in FIG. 4, after the paint has passed through the paint discharge holes 40, the paint flows out to the first paint discharge surface 56 of the first bell cup 44. The paint flows toward the front end of the first bell cup 44 through the first clearance S1 between the enlarged diameter portion 36 of the inner member 16 and the first paint discharge surface 56. A portion of the paint flows out toward the second bell cup 46 through the plurality of through holes 70 opened on the first paint discharge surface 56.

At this time, the total opening area obtained by adding the opening areas of the plurality of through holes 70 is ½ of the circumferential area of the first paint discharge surface 56. Therefore, half (½) of the paint supplied from the inner member 16 toward the first bell cup 44 flows to the first paint discharge surface 56 of the first flare portion 52. The remaining half (½) of the paint flows to the second paint discharge surface 58 of the second flare portion 54 through the plurality of through holes 70.

That is, the amount of the paint supplied from the inner member 16 toward the outer member 18 is evenly distributed to the first bell cup 44 and the second bell cup 46 by the plurality of through holes 70. In other words, in the rotary atomizing coating device 10, the flow of the paint is divided on the outer periphery of the inner member 16 into flow of the paint supplied to the first bell cup 44 and flow of the paint supplied to the second bell cup 46.

In this manner, the paint is evenly supplied to the first paint discharge surface 56 and the second paint discharge surface 58. Due to the centrifugal force generated by the rotation of the first and second bell cups 44 and 46, the paint flows radially outward along the first and second paint discharge surfaces 56 and 58 and is thinned. Thereafter, the paint is discharged from the outer edge portions that are the front ends of the first and second flare portions 52 and 54. The paint is atomized as paint particles.

At this time, in the rotary atomizing coating device 10, a high voltage is applied between the rotary atomizing head 12 and a workpiece which is an object to be coated. Therefore, after the paint particles are atomized and charged in the rotary atomizing head 12, the paint particles fly toward the workpiece and are applied thereto.

As described above, in the first embodiment, the rotary atomizing head 12 of the rotary atomizing coating device 10 includes the first bell cup 44, the second bell cup 46, the paint supply passage 20 (the tube member 22), and the inner member 16.

The first bell cup 44 has the first paint discharge surface 56 for thinning the paint by the centrifugal force. The second bell cup 46 is fitted to the outer side of the first bell cup 44. The second bell cup 46 has the second paint discharge surface 58 for thinning the paint. The paint supply passage 20 extends inside the rotary shaft 14 and the paint is supplied through the paint supply passage 20. The inner member 16 is disposed inside the first bell cup 44 and communicates with the paint supply passage 20. The outer peripheral wall 30 of the inner member 16 is provided with the paint discharge holes 40. The paint discharge holes 40 and the paint supply passage 20 communicate with each other. The first bell cup 44 includes the through holes 70. The through holes 70 are disposed near the paint discharge holes 40 and communicate with the second bell cup 46.

The conventional rotary atomizing coating device is provided with paint passage branch holes for discharging paint to two head bodies. In the present invention, the first bell cup 44 includes the plurality of through holes 70 for supplying paint toward the second bell cup 46. By appropriately setting the shape and the number of the through holes 70, it is possible to adjust, at a desired ratio, the amount of the paint supplied to the first bell cup 44 and the amount of the paint supplied to the second bell cup 46 through the paint discharge holes 40 of the inner member 16.

As a result, with a simple configuration including the two first and second bell cups 44 and 46, the rotary atomizing coating device 10 can distribute the paint by adjusting the discharge ratio between the paint discharged to the first bell cup 44 and the paint discharged to the second bell cup 46. Therefore, even when the amount of the paint supplied to the rotary atomizing head 12 is increased, the thickness of the liquid film of the paint on the workpiece can be thinned and the paint can be atomized.

The outer member 18 has a two-layer structure including the first and second bell cups 44 and 46. Therefore, the liquid film per layer can be made thinner without increasing the rotational speed of the rotary atomizing head 12 as compared with a rotary atomizing coating device having a single-layer structure. As a result, the paint particles can be atomized.

In other words, compared with the rotary atomizing coating device having the single-layer structure, even when the rotary atomizing head 12 is rotated at a lower rotational speed, the paint particles can be atomized to the same degree as the paint particles obtained by the rotary atomizing coating device having the single-layer structure.

The plurality of through holes 70 are arranged on the same circumference in the first flare portion 52 of the first bell cup 44. The plurality of through holes 70 are disposed to be spaced apart from each other by the length of the through holes 70 in the circumferential direction. The total opening area obtained by adding the opening areas of the plurality of through holes 70 is set to be ½ of the circumferential area of the first flare portion 52.

As a result, half of the paint supplied from the inner member 16 to the first bell cup 44 can be supplied to the second bell cup 46 through the plurality of through holes 70. Thus, by setting the total opening area (projected area) of the plurality of through holes 70 to ½ of the circumferential area, it is possible to evenly distribute the paint to the first bell cup 44 and the second bell cup 46.

The paint discharge holes 40 of the inner member 16 and the through holes 70 of the first bell cup 44 are substantially aligned with each other when viewed from a position in the axial direction of the rotary shaft 14, that is, in the front-rear direction of the rotary atomizing head 12 (the directions of arrows A and B). The through hole 70 penetrates in a radial direction orthogonal to the front-rear direction of the first bell cup 44.

When the rotary atomizing head 12 rotates and the centrifugal force acts on the paint, no component force is generated in the paint and only a centrifugal force in the radial direction is uniformly applied to the paint. Thus, it is possible to evenly distribute the paint from the paint storage chamber 26 to each of the through holes 70 by using the centrifugal force.

The maximum outer diameter D1 of the first bell cup 44 is identical to the maximum outer diameter D2 of the second bell cup 46 (D1=D2 in FIG. 1). As a result, the amount of the paint discharged radially outward from the first bell cup 44 and the amount of the paint discharged radially outward from the second bell cup 46 can be made even.

The size of the paint particles discharged radially outward from the first bell cup 44 and the size of the paint particles discharged radially outward from the second bell cup 46 can be made even.

Next, a rotary atomizing coating device 80 according to a second embodiment is shown in FIGS. 6 to 10. The same components as those of the rotary atomizing coating device 10 according to the first embodiment described above are denoted by the same reference numerals, and detailed description thereof is omitted.

The rotary atomizing coating device 80 includes a plurality of paint discharge holes 86. The plurality of paint discharge holes 86 are disposed in the outer peripheral wall 30 of an inner member 84 constituting a rotary atomizing head 82. The plurality of paint discharge holes 86 penetrate the outer peripheral wall 30 in the radial direction. A first bell cup 88 includes a plurality of through holes 90. The plurality of through holes 90 are disposed on the first paint discharge surface 56 that is on the outer peripheral side of the paint discharge holes 86. The number of the through holes 90 is half the number of the paint discharge holes 86.

The rotary atomizing coating device 80 includes the plurality of paint discharge holes 86 and the plurality of through holes 90. In this respect, the rotary atomizing coating device 80 is different from the rotary atomizing coating device 10 according to the first embodiment.

The outer peripheral wall 30 of the inner member 84 in the rotary atomizing head 82 is provided with the plurality of paint discharge holes 86. The plurality of paint discharge holes 86 are disposed adjacent to the rear end of the enlarged diameter portion 36. The cross-sectional shape of the paint discharge hole 86 is circular. Each of the paint discharge holes 86 penetrates the outer peripheral wall 30 in the radial direction. Each of the paint discharge holes 86 allows communication between the outside of the outer peripheral wall 30 and the paint storage chamber 26. The plurality of paint discharge holes 86 are aligned with each other when viewed from a position in the front-rear direction of the inner member 84 (the directions of arrows A and B). The plurality of paint discharge holes 86 are arranged along the circumferential direction in the outer peripheral wall 30. The plurality of paint discharge holes 86 are arranged at equal intervals in the circumferential direction of the inner member 84.

The paint discharge holes 86 include first hole portions 92 and second hole portions 94. The first hole portion 92 and the second hole portion 94 have the same shape. The number of the first hole portions 92 is the same as the number of the second hole portions 94. The first hole portions 92 and the second hole portions 94 are alternately arranged adjacent to each other along the circumferential direction of the outer peripheral wall 30. That is, the paint discharge holes 86 are configured such that the number of the first hole portions 92 and the number of the second hole portions 94 are equal.

The first bell cup 88 of the outer member 18 includes the first paint discharge surface 56 of the first flare portion 52. The first paint discharge surface 56 is disposed outside the enlarged diameter portion 36. The first paint discharge surface 56 includes the plurality of through holes 90. The plurality of through holes 90 are arranged along the circumferential direction of the first flare portion 52.

Each of the through holes 90 has, for example, the same diameter as the paint discharge hole 86 and has a circular cross-sectional shape. The plurality of through holes 90 are aligned with each other when viewed from a position in the front-rear direction of the first bell cup 88 (the directions of arrows A and B). That is, the plurality of through holes 90 are arranged on a single imaginary circle in the first bell cup 88.

Figure 10:
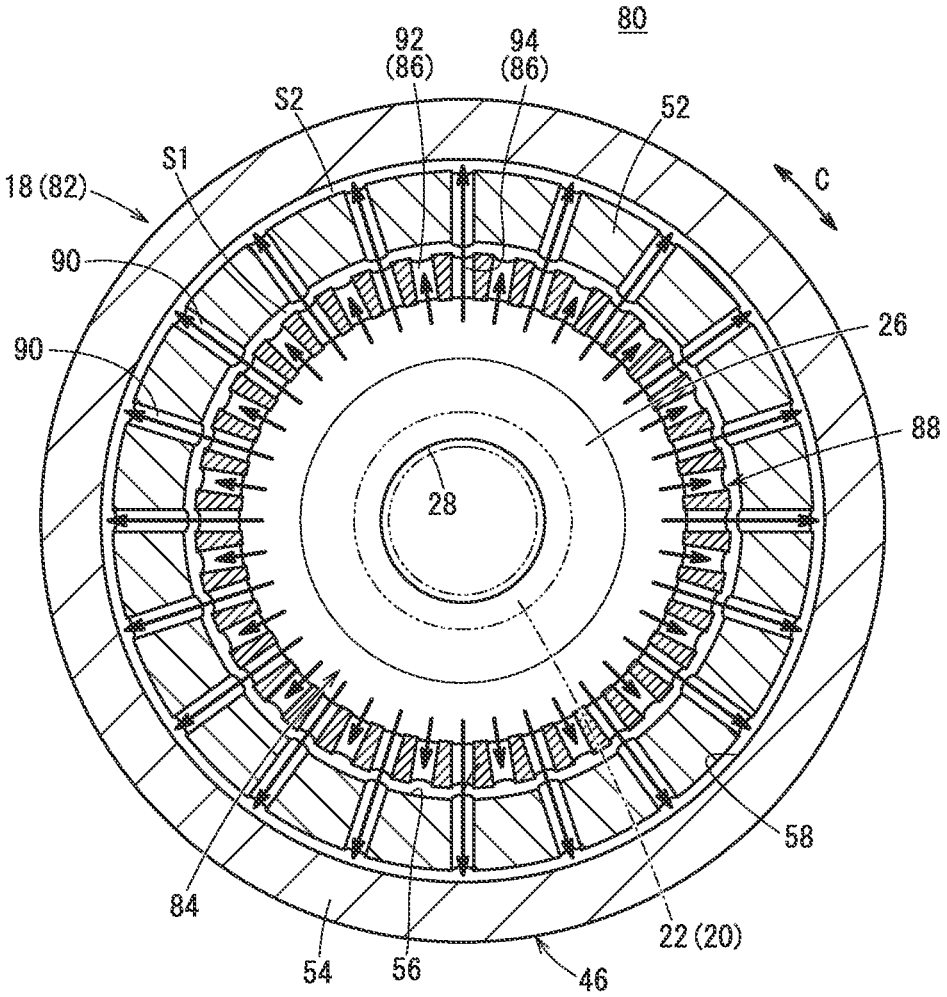
FIG. 10 is a cross-sectional view taken along line X-X of FIG. 6.

As shown in FIG. 10, the plurality of through holes 90 are arranged at equal intervals along the circumferential direction of the first bell cup 88. Each of the through holes 90 is disposed radially outward of the second hole portion 94 of the paint discharge hole 86. The through hole 90 and the second hole portion 94 adjacent to each other in the radial direction are arranged on a straight line in the radial direction. The through hole 90 and the second hole portion 94 adjacent to each other in the radial direction communicate with each other.

That is, the number of the through holes 90 is the same as the number of the second hole portions 94. In the circumferential direction of the first bell cup 88, the plurality of through holes 90 are disposed at positions shifted from the plurality of first hole portions 92. In other words, the through holes 90 communicate with half (½) of the paint discharge holes 86.

Next, the operation and effects of the rotary atomizing coating device 80 will be described.

Figure 9:
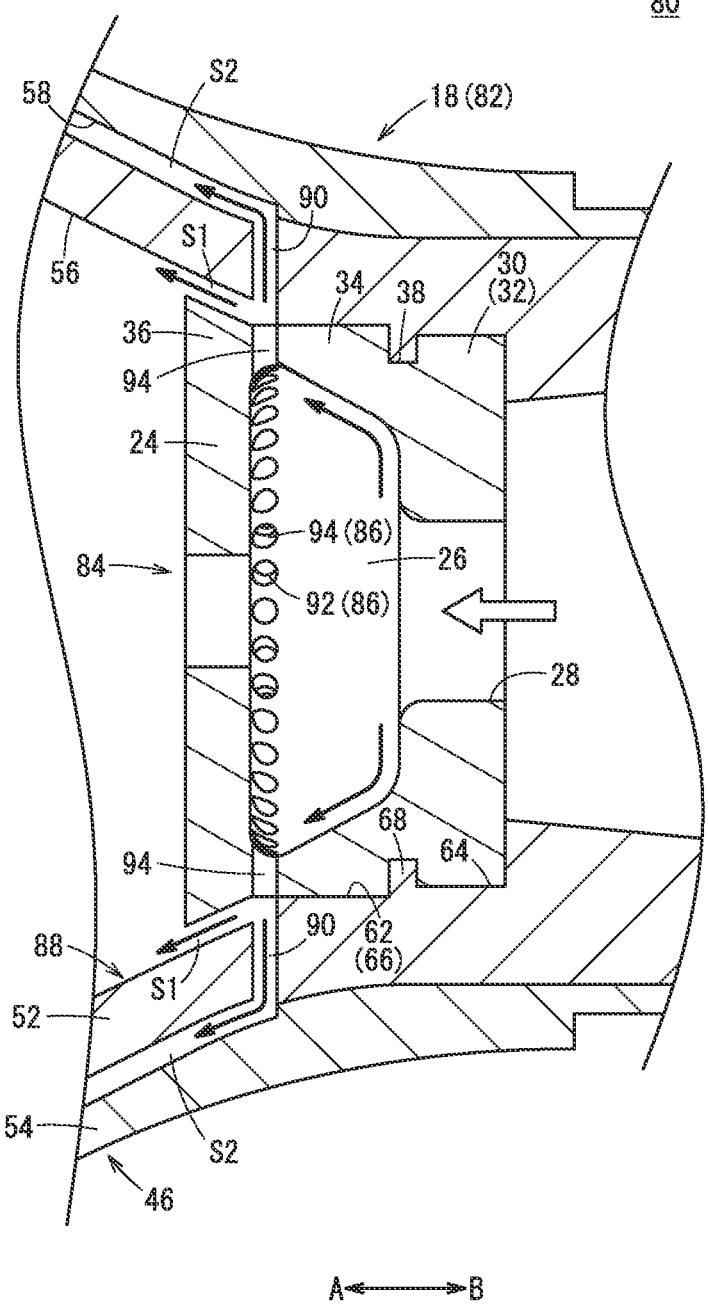
FIG. 9 is an enlarged cross-sectional view of the vicinity of an inner member in the rotary atomizing head of FIG. 6.

First, a rotary drive source (not shown) is driven. As the rotary shaft 14 of the rotary drive source rotates, the rotary atomizing head 82 rotates at high speed. As shown in FIG. 9, the paint supplied to the paint storage chamber 26 of the inner member 84 moves radially outward in the paint storage chamber 26 by a centrifugal force.

The paint moves forward (in the arrow A direction) along the inner peripheral surface of the paint storage chamber 26. The paint is discharged to the radially outer side of the inner member 84 through the plurality of paint discharge holes 86.

The plurality of paint discharge holes 86 are opened at equal intervals along the circumferential direction of the inner member 16. Therefore, the paint is discharged substantially evenly along the circumferential direction of the inner member 84 through the first and second hole portions 92 and 94 of the paint discharge holes 86. In other words, the paint is discharged radially and substantially evenly over the entire circumference of the inner member 84.

The paint discharged from the plurality of first hole portions 92 is supplied to the first clearance S1 between the first paint discharge surface 56 and the inner member 16. Thereafter, the paint flows toward the front end of the first bell cup 88 through the first clearance S1.

On the other hand, the paint discharged from the second hole portions 94 of the paint discharge holes 86 passes through the through holes 90 and flows out toward the second bell cup 46. That is, a portion of the paint passes through the through holes 90, the number of which is half the number of the paint discharge holes 86. As a result, the amount of the paint that passes through the first hole portions 92 and is supplied to the first bell cup 88 and the amount of the paint that passes through the second hole portions 94 and the through holes 90 and is supplied to the second bell cup 46 are equalized.

In this way, the paint is evenly supplied to the first paint discharge surface 56 of the first bell cup 88 and the second paint discharge surface 58 of the second bell cup 46. Due to the centrifugal force generated by the rotation of the first and second bell cups 88 and 46, the paint flows radially outward along the first and second paint discharge surfaces 56 and 58, and is thinned. Thereafter, the paint is discharged from the outer edge portions that are the front ends of the first and second flare portions 52 and 54. The paint is atomized as paint particles and discharged. After the paint particles are discharged from the first and second bell cups 88 and 46, the paint particles fly toward the workpiece and are applied thereto.

In other words, in the rotary atomizing coating device 80, the paint is passed through the plurality of paint discharge holes 86 in the inner member 84. Thus, the paint supplied to the inner member 84 is divided into paint supplied toward the first bell cup 88 and paint supplied toward the second bell cup 46. As a result, compared to the rotary atomizing coating device 10 according to the first embodiment, the rotary atomizing coating device 80 is capable of dividing the flow of the paint on the further upstream side in the flow path of the paint.

As described above, in the second embodiment, the rotary atomizing head 82 of the rotary atomizing coating device 80 includes the first bell cup 88, the second bell cup 46, the paint supply passage 20, and the inner member 84. The first bell cup 88 has the first paint discharge surface 56 for thinning the paint by the centrifugal force. The second bell cup 46 is fitted to the outer side of the first bell cup 88. The second bell cup 46 has the second paint discharge surface 58 for thinning the paint.

The paint supply passage 20 extends inside the rotary shaft 14 and the paint is supplied through the paint supply passage 20. The inner member 84 is disposed inside the first bell cup 88 and communicates with the paint supply passage 20. The outer peripheral wall 30 of the inner member 84 includes the plurality of paint discharge holes 86. The plurality of paint discharge holes 86 communicate with the paint supply passage 20. The first bell cup 88 includes the plurality of through holes 90. The plurality of through holes 90 penetrate toward the second bell cup 46. The second hole portions 94 of the paint discharge holes 86 and the through holes 90 are aligned with each other when viewed from a position in the circumferential direction, and the second hole portions 94 and the through holes 90 communicate with each other.

The conventional rotary atomizing coating device is provided with paint passage branch holes for discharging paint to two head bodies respectively. In the present invention, the paint can be distributed by adjusting the amount of the paint supplied to the first bell cup 88 and the amount of the paint supplied to the second bell cup 46 at a desired ratio by appropriately setting the number of the through holes 90 in the first bell cup 88.

As a result, in the rotary atomizing coating device 80, by providing the two first and second bell cups 88 and 46, it is possible to reduce the thickness of the liquid film of the paint and atomize the paint. In the rotary atomizing coating device 80, with a simple configuration, the paint can be distributed by appropriately adjusting the discharge ratio between the paint discharged from the first bell cup 88 and the paint discharged from the second bell cup 46.

The paint is passed through the plurality of paint discharge holes 86 in the inner member 84. As a result, the flow of the paint can be reliably and easily divided into the flow of the paint supplied to the first bell cup 88 and the flow of the paint supplied to the second bell cup 46. Therefore, compared with the rotary atomizing coating device 10 according to the first embodiment, the paint can be distributed on the further upstream side. As a result, in the rotary atomizing coating device 80, it is possible to more reliably distribute the paint evenly along the circumferential direction.

The paint discharge holes 86 and the through holes 90 are substantially aligned with each other when viewed from a position in the front-rear direction of the rotary atomizing head 82 (the directions of arrows A and B). The paint discharge holes 86 and the through holes 90 penetrate in a radial direction orthogonal to the front-rear direction. Therefore, when the rotary atomizing head 82 rotates and the centrifugal force acts on the paint, no component force is generated in the paint and only a centrifugal force in the radial direction is uniformly applied to the paint. As a result, it is possible to evenly distribute the paint from the paint storage chamber 26 to each of the through holes 90.

Figure 6:
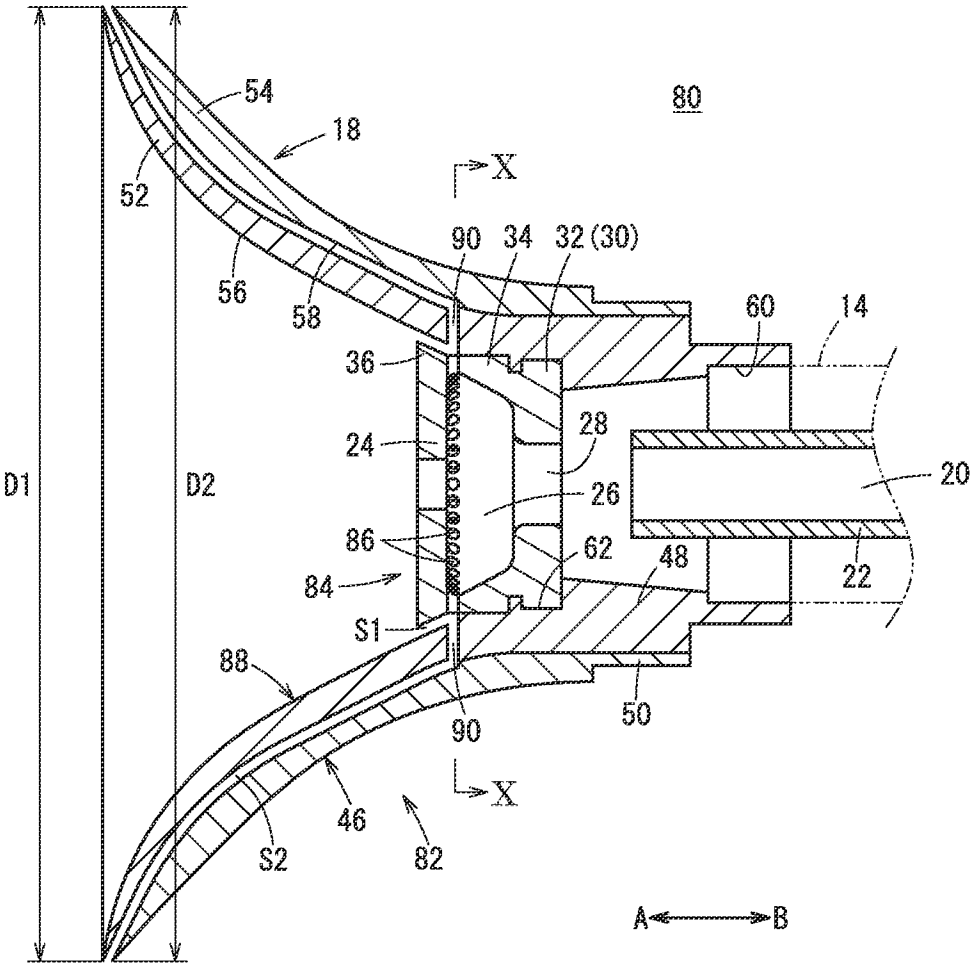
FIG. 6 is an overall cross-sectional view of a rotary atomizing coating device according to a second embodiment of the present invention.
Figure 7:
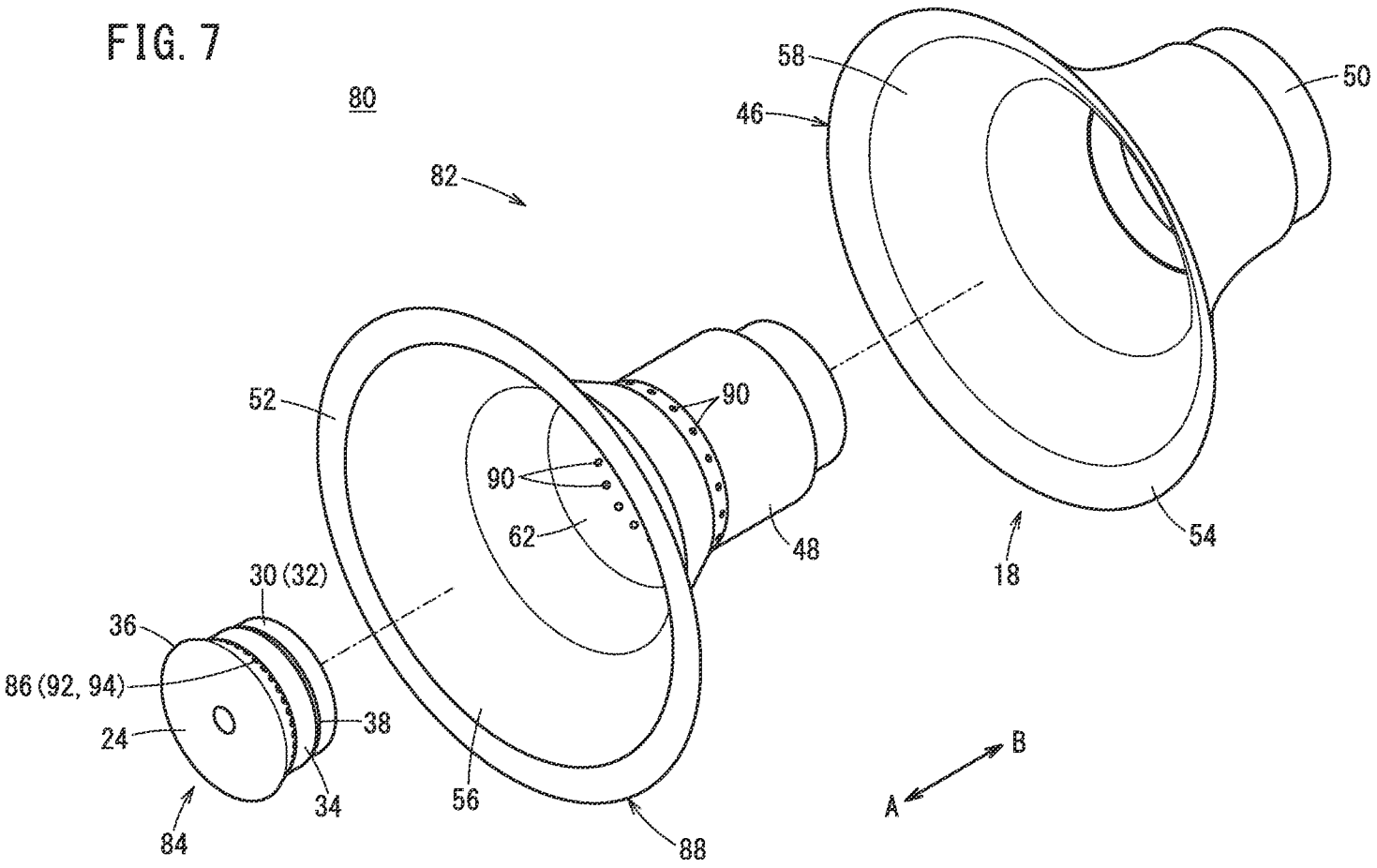
FIG. 7 is an exploded perspective view of a rotary atomizing head in the rotary atomizing coating device of FIG. 6.
Figure 8:
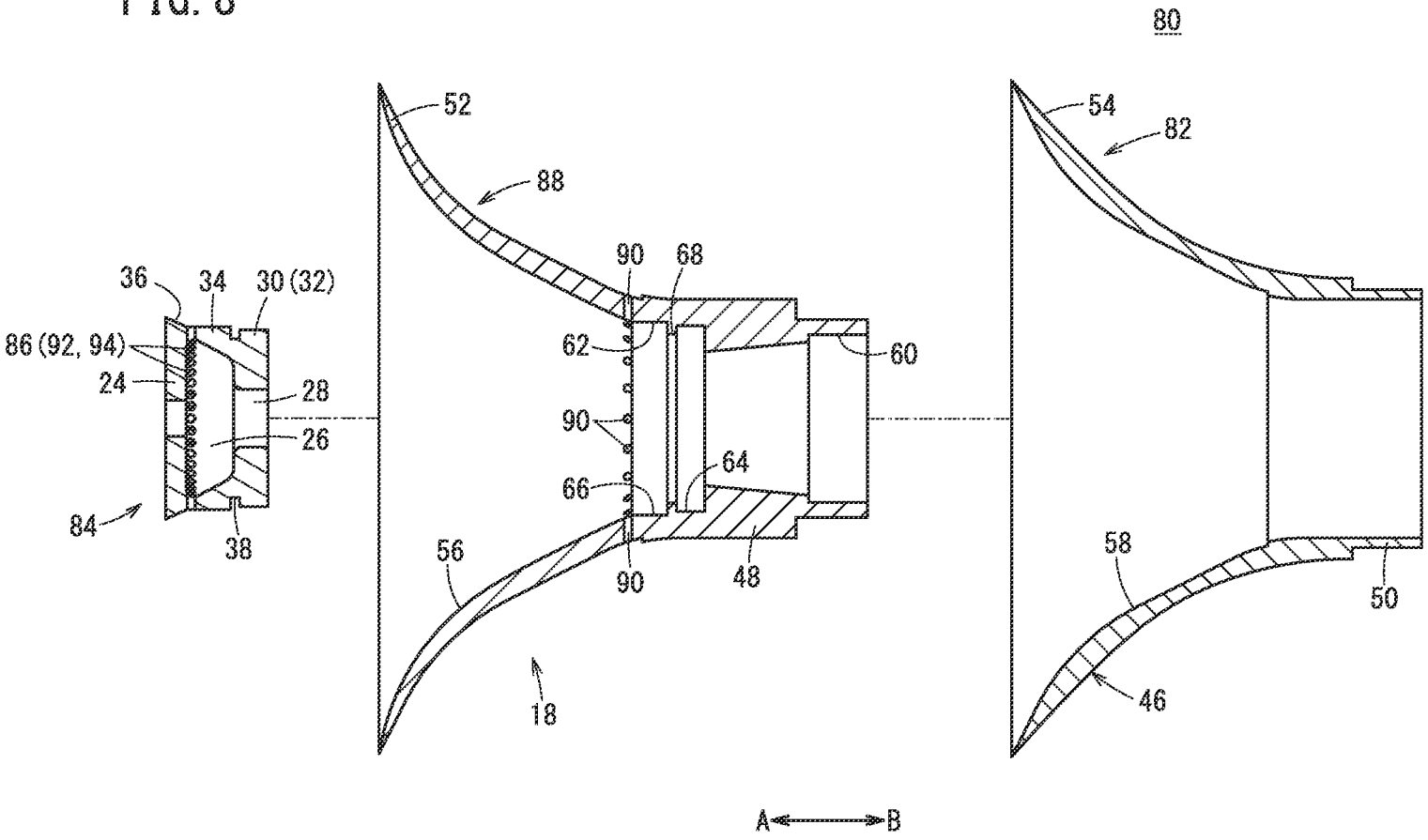
FIG. 8 is an exploded cross-sectional view of the rotary atomizing head in the rotary atomizing coating device of FIG. 6.

The maximum outer diameter D1 of the first bell cup 88 is identical to the maximum outer diameter D2 of the second bell cup 46 (D1=D2 in FIG. 6). As a result, the amount of the paint discharged radially outward from the first bell cup 88 and the amount of the paint discharged radially outward from the second bell cup 46 can be made even. The size of the paint particles discharged radially outward from the first bell cup 88 and the size of the paint particles discharged radially outward from the second bell cup 46 can be made even.

Note that the present invention is not limited to the embodiments described above, and various configurations can be adopted therein without departing from the gist of the present invention.

What is claimed is:

1. A rotary atomizing coating device comprising a rotary atomizing head coupled to a rotary shaft of a rotary drive source and configured to discharge a paint by a centrifugal force caused by rotation thereof, the rotary atomizing coating device coating a workpiece with the discharged paint, wherein the rotary atomizing head includes:

a first bell cup including a first paint discharge surface configured to thin the paint by the centrifugal force;

a second bell cup fitted to an outer side of the first bell cup and including a second paint discharge surface configured to thin the paint;

a paint supply passage which extends in an axial direction of the rotary shaft and through which the paint is supplied; and an inner member disposed inside the first bell cup and communicating with the paint supply passage, and wherein an outer peripheral surface of the inner member includes a paint discharge hole communicating with the paint supply passage, and the first bell cup is formed with, at a position near the paint discharge hole, a through hole communicating with the second bell cup, and the paint discharge hole faces the first paint discharge surface and the through hole in a radial direction of the first bell cup.

2. The rotary atomizing coating device according to claim 1, wherein a plurality of the through holes are disposed on an outer peripheral surface of the first bell cup along a circumferential direction thereof, and the plurality of through holes are disposed to be spaced apart from each other by a length of each of the through holes in the circumferential direction.

3. The rotary atomizing coating device according to claim 1, wherein the paint discharge hole is one of a plurality of discharge holes, wherein the plurality of discharge holes includes:

a first hole portion that faces the first paint discharge surface of the first bell cup in a radial direction and discharges the paint toward the first bell cup; and a second hole portion that faces the through hole in the radial direction and discharges the paint toward the second bell cup through the through hole, and the second hole portion and the through hole are aligned with each other when viewed from a position in a circumferential direction of the inner member, and communicate with each other.

4. The rotary atomizing coating device according to claim 1, wherein the paint discharge hole and the through hole are substantially aligned with each other when viewed from a position in the axial direction of the rotary shaft, and the through hole penetrates in a direction orthogonal to the axial direction.

5. The rotary atomizing coating device according to claim 1, wherein a diameter of a large-diameter-side opening of the first bell cup is identical to a diameter of a large-diameter-side opening of the second bell cup.

* * * * *